United States Patent [19]

Bailey

[11] 4,335,474

[45] Jun. 22, 1982

[54] SWIMMING POOL LINER SUPPORTS AND COPING

[76] Inventor: Howard S. Bailey, The Gables, 60 Turnpike Rd., Croesyceiliog, Cwmbran, England

[21] Appl. No.: 152,917

[22] Filed: May 23, 1980

[30] Foreign Application Priority Data

May 24, 1979 [GB] United Kingdom ..... 7918136

[51] Int. Cl.[3] ..... E04H 3/18

[52] U.S. Cl. ..... 4/506; 4/513; 52/102

[58] Field of Search ..... 4/488, 496, 503, 506, 4/510, 513, 494, 580, 584, DIG. 18; 52/169.1, 169.7, 102, 300

[56] References Cited

U.S. PATENT DOCUMENTS 3,347,006 10/1967 Fox ..... 52/300
3,512,326 5/1970 Greene ..... 4/488 X
3,557,391 1/1971 West ..... 52/169.7
3,839,748 10/1974 Stillman ..... 52/300

*Primary Examiner*—Stuart S. Levy
*Attorney, Agent, or Firm*—Trexler, Bushnell & Wolters, Ltd.

[57] ABSTRACT

A support for a pool liner (8) comprises interlocking mouldings (1,2). A slot (3) in one moulding (1) receives the top of the rigid wall (4) of the pool and a locking groove (5) receives the beaded head (7) of the liner (8), while in upwardly opening slot (9) receives an elongated rib (10) of the other moulding (2). The two mouldings (1,2) are also linked by a rib (11) and groove (12) formation and mask the fixing of the liner to the moulding (1) and the void space (13) behind the top portion of the liner (8) where the liner could readily become damaged. The two mouldings (1, 2A) can also be moulded additionally to form a smooth edging to the pool.

8 Claims, 1 Drawing Figure

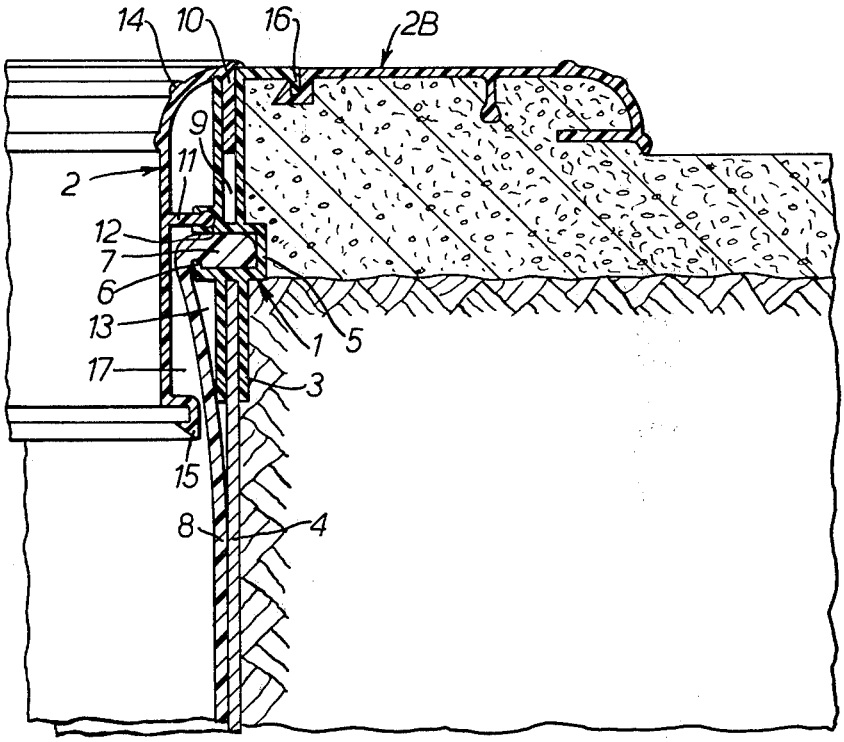
14
10
16
2B
9
11
2
12
7
6
13
17
1
5
3
15
8
4

SWIMMING POOL LINER SUPPORTS AND COPING

This invention is concerned with a support arrangement for retaining the top edge of a swimming pool liner. Prefabricated swimming pools are constructed from linked panels and the panels and base are then lined with a preformed plastics liner. Obviously the outer edge of this liner has to be held in place at the top of the panel walls and in one conventional arrangement a liner locking groove projects inwardly of a fitting secured to the top of the panel walls and receives a bead formed at the top edge of the liner. The upper part of the fitting defines the edge of a coping which surrounds the pool edge. With this particular construction the interconnection of the liner bead with the fitting is visible and there is sometimes a void region behind the upper portion of the lining. The general appearance is not very attractive as the liner lock and liner bead are visible and there is also a possibility that the liner on certain designs can be pushed inwardly into the void region, which can result in damage to the liner.

It is an object of this invention to provide a secure support arrangement for a swimming pool liner which is also attractive in appearance yet flexible in design to accommodate freeform pools.

Accordingly this invention provides a swimming pool liner support comprising a first portion having a slot at its lower end to be positioned over the top edge of a pool wall and a liner locking groove for receipt of a top bead on the liner, opening at one side of the first portion, and a second portion, the two portions having mutually interlocking connection parts whereby the second portion will be interconnected to the first portion so as to cover the opening of the locking groove and provide a slot between the lower ends of both portions through which the pool liner will pass.

With the two portions interlocked with one another, the upper part of the liner, including the liner bead, is protected by the second portion of the support and the liner locking groove retaining the liner bead is also hidden from view. This therefore gives an attractive appearance and protects the upper part of the liner from being tampered with or damaged.

In the preferred embodiment, the interlocking connection part of the first portion comprises an upwardly extending second slot. Ideally the two slots in the first portion are symmetrically positioned to either side of the liner locking groove. With this arrangement, part of the liner locking groove will extend through the vertical axis of the first portion so that the liner bead will be held directly above the top edge of the pool wall so that there will only be a small void between the pool wall and the upper part of the liner (which will in any case be covered by the second portion). Ideally the second portion has an elongated rib for receipt in the second slot of the first portion. Improved security of interlocking of the two portions may be made by providing that the second portion has a second rib fitting in a retaining groove in the side of the first portion at a position above the liner locking groove.

The lower end of the second portion may be enlarged or otherwise shaped for added strength. Furthermore the support may be so formed that the enlarged lower end of the second portion is provided with a groove and the upper end of the first portion has an extension projecting in a direction opposite to the opening of the liner locking groove such that the extension in the first portion and the groove in the enlarged lower end of a second portion may be interconnected so that that second portion will lie at right angles to the first portion. Thus the support may comprise the combination of a first portion and the second portion, one of which is interconnected with the first portion in the usual way and the second of which extends outwardly from the pool periphery to form part of the pool edging surfaces.

The two portions are preferably formed by a moulding or extrusion process and thus may be formed, for example, from plastics and/or aluminium.

The invention also extends to the combination of a swimming pool liner and a support as hereinbefore defined wherein a top bead on the liner is received and held within the liner locking groove of the first portion and the top part of the liner is covered by the second portion interconnected with the first portion.

The invention may be performed in various ways and one preferred embodiment thereof will now be described with reference to the accompanying drawing which illustrates, in cross-section, a portion of a swimming pool liner support constructed in accordance with this invention.

The support shown in the drawing comprises a first portion 1 and a second portion 2 both formed from a plastics material by an extrusion process. The first portion 1 has a downwardly extending slot 3 which locates over the top edge of a panel 4 forming a rigid wall of the pool. Above the slot 3 there is formed a liner locking groove 5 formed with a rib 6 which holds in place the shaped beaded head 7 of a pool liner 8 by means of a snap-fit. A second slot 9 extends upwardly from the groove 5 and receives an elongated rib 10 forming part of the second portion 2. A second rib 11 on the second portion 2 is received as a snap-fit within a retaining groove 12 in the side of the first portion 1 just above the locking groove 5.

When the two parts 1 and 2 are interconnected in the manner illustrated in the drawing the locking of the beaded head 7 of the liner 8 within the liner locking groove 5 is hidden from view as also is the small void space 13 between the liner 8 and the part of the first portion 1 forming the slot 3. Indeed in the final construction the only visible part of the support is the portion 2 which can be made to have an attractive appearance and include such formations as the beads 14 which provide improved grip for a user of the swimming pool. The lower end of the portion 2 has a shaped part 15 which forms a face tending to hold the liner against the panel 4 of the swimming pool and also providing added strength in this lower edge and limiting access to the space 17 between the portions 1 and 2. The formed part 15 also serves another purpose in that it enables a portion 2A of identical design to the second portion 2 to be laid on the ground surface so as to interlock with a flange 16 formed on the part 1. This is illustrated at 2A and the result is an attractive coping effect for the edge of the swimming pool. Concrete or some other filling material can be employed to fill the space below the part 2A.

Formation of the support in two parts 1 and 2 creates several advantages, the first of which is the fact that the interconnection between the support and the liner can be hidden from view. Additionally, however, where the pool edge is to be of curved form each of the parts 1 and 2 may be more readily formed into a curved shape than would a single member of generally similar form to the final support because differential curvature of each of the parts 1 and 2 is made possible. Furthermore, the part 1 itself is generally symmetrical about the slot 3 so that curvature of this part is also symmetrical to either side of the edge of the top wall 4 of the pool. The added flexibility achieved also enables smooth curvature of relatively small radius to be formed.

Whilst the support illustrated in FIG. 1 is preferred it may of course be modified as may occur to those skilled in the art. For example, if the top edge of the panel 4 was formed with an out-turned lip the slot part 3 of the portion 1 could then lie horizontal with its mouth opening below and just behind the retaining groove 5.

I claim:

1. A swimming pool liner support comprising a vertically oriented first portion having a front and back surface corresponding to the front and back surface of the pool wall to which it is to be attached, the vertically oriented first portion being of shallow width between the front and back surfaces, the lower end of the first portion defining a slot to be positioned over the top edge of the pool wall, said first portion having a second slot extending opposite from said first slot, the front surface of the first portion defining a liner locking groove between said two slots for receipt of a top bead of the pool liner, a vertically oriented second portion also having a front and back surface and being of shallow width between the front and back surfaces, the two portions having mutually interlocking connection parts wherein the second portion will be interconnected to the first portion through said second slot and adjacent said liner locking groove so that the two portions will extend substantially parallel to one another in a vertical direction, whereby differential curvature between the two portions is enabled when mounted on a pool wall defining a pool shape exhibiting substantial curvature, the lower end of the second portion extending below the liner locking groove on the first portion so as to cover the opening of the locking groove and provide a slot between the lower ends of both portions through which the pool liner will pass.

2. A support according to claim 1, wherein the second portion has an elongated rib for receipt in the second slot of the first portion.

3. A support according to claim 2, wherein the second portion has a second rib fitting in a retaining groove in the side of the first portion at a position above the liner locking groove.

4. A support according to claim 1, wherein the lower end of the second portion is for added strength.

5. A support according to claim 4, further including a coping provided with a groove and the upper end of the first portion has an extension projecting from its back surface, said groove and part of said extension being of complementary shape enabling the two portions to be linked wherein the coping portion will lie at right angles to the first portion.

6. A support according to claim 1, wherein the two portions are formed by a moulding or extrusion process.

7. A support according to claim 6, wherein the two portions are formed from plastics.

8. The combination of a swimming pool liner and a support as claimed in claim 1, wherein a top bead on the liner is received and held within the liner locking groove of the first portion and the top part of the liner is covered by the second portion interconnected with the first portion.

* * * * *